US006419092B1

(12) United States Patent
Brown

(10) Patent No.: US 6,419,092 B1
(45) Date of Patent: Jul. 16, 2002

(54) METHOD AND APPARATUS FOR MANUFACTURING SURGICAL NEEDLES

(75) Inventor: Michael J. Brown, deceased, late of San Angelo, TX (US), by Mary Brown, administrarix

(73) Assignee: Ethicon, Inc.

( * ) Notice: Subject to any disclaimer, the term of this patent is extended or adjusted under 35 U.S.C. 154(b) by 0 days.

(21) Appl. No.: 08/839,512

(22) Filed: Apr. 14, 1997

(51) Int. Cl.[7] ..... B07C 9/00

(52) U.S. Cl. ..... 209/653; 209/571

(58) Field of Search ..... 209/587, 576, 209/939, 653, 598, 522, 586, 571

(56) References Cited

U.S. PATENT DOCUMENTS 5,419,441 A * 5/1995 Hirsch ..... 209/587

* cited by examiner

*Primary Examiner*—Kenneth Noland
(74) *Attorney, Agent, or Firm*—Herbert J. Hammnond

(57) ABSTRACT

An improved needle inspection station for use in a combined index machine for forming drilled taper point needles of the type having a plurality of chucks mounted on a rotating platform adapted to selectively engage and release a needle to be formed, a rotary drive for indexing the platform and the chucks through a plurality of radial positions, and a plurality of work stations circumferentially disposed adjacent the radial positions occupied by the chucks. A needle inspection platform slidably mounted on the baseplate reciprocally movable toward and away from a chuck occupying a position adjacent the inspection station. A slide member is movable toward the chuck to permit the gripper to engage the needle, retract it from the chuck and rotate it 180 degrees to reverse the orientation of the needle relative to the chuck. The slide member is then movable back toward the chuck to allow the gripper to replace the needle in the chuck. The needle inspection platform is moveable toward the chuck to permit the needle point to be tested. The needle inspection platform includes a stop containing a resilient conductive material at the leading edge of the platform and a strip of nonconductive material disposed between the stop and the chuck, such that when the strip is moved into contact with a needle extending from a chuck, a properly formed needle point will penetrate the strip and make electrical contact with the stop, thereby signaling a programmable logic controller connected to the stop that a properly formed needle has been detected.

7 Claims, 8 Drawing Sheets

METHOD AND APPARATUS FOR MANUFACTURING SURGICAL NEEDLES

BACKGROUND OF THE INVENTION

The present invention relates to the manufacture of surgical needles for use in surgical sutures and more particularly to an improved method and apparatus for inspecting needle points during the manufacture of drilled taper point needles for surgical sutures.

In the manufacture of drilled taper point needles for use in surgical sutures, wire from a spool is formed into sharpened needle blanks by unspooling the wire in a machine called a Bundgen machine, which cuts the wire into needle blanks of predetermined length. The needle blanks are then introduced into a Schumag machine, which grinds a taper point having a predetermined profile on one end of the needle. The point may require multiple passes on the Schumag machine to obtain the proper configuration. The blanks are then packaged and stored until needed.

The needles are processed by one or more index machines which perform various operations necessary to form a curved needle with a hole of predetermined depth drilled in the barrel end thereof. After the needle is formed, a suture is threaded into the hole, the needle is crimped at the barrel end to attach the needle to the suture and winding, the completed suture is placed in its primary packaging, the primary package containing the suture is sterilized then placed in secondary packaging, and the secondary packaging is inspected before the product is shipped.

For many years, the process for forming a drilled taper point needle required a pair of index machines operating in tandem for carrying out the various operations required to form a tapered point needle. The index machines, actuated by a rotary drive, typically contained space for up to eight stations circumferentially mounted on a circular table. A rotating platform, actuated by a rotary drive, was provided in the center of the table and contained a series of eight chucks circumferentially spaced apart at 45 degree angles. In the first index machine needle blanks were introduced one blank at a time to a rotating chuck, where the blank was successively sheared, a hole was drilled in the barrel end thereof, the hole was inspected and bad needles were rejected. Because not all of the required operations could be carried out on the eight stations of the first index machine, it was necessary to unload the needles from the first machine, wash and dry the semi-finished needles to remove the drill cooling oil and subsequently introduce them into a second index machine where the remaining processing steps could be carried out. On the second index machine, the semi-finished needles were subjected to a series of grinding and polishing stations to finish and retouch the needle point, which was often damaged as the needles were introduced into the chucks in the first or second machines. After further grinding and polishing on the second index machine, the point was inspected, ribs were formed on the needle by a flattening press and the needle was curved to the proper radius and unloaded. The completed needles were then washed and dried again and sent to a static anode for finishing.

In the late 1980s and early 1990s, it was determined that major cost savings could be achieved by the elimination of needle makers and the intermediate steps of degreasing semi-finished needles if the operations of the index machines could be combined into a single machine. Index machines were built and successfully operated in the late 1980s and early 1990s in which the essential functions carried out by the two index machines were combined in a single combined index machine. Unfortunately, one of the stations that had to be eliminated to combine the essential functions into eight stations was the needle point inspection previously employed in the second index machine. While the combined index machines could be operated at significant cost savings and had many other advantages, the elimination of the needle point inspection function from the combined machines did not provide the operators with desired quality control. Accordingly, a need arose for a needle point inspection station in the combined index machines.

BRIEF SUMMARY OF THE INVENTION

The specification discloses an improved needle inspection station for use in a combined index machine for forming drilled taper point needles of the type having a plurality of chucks mounted on a rotating platform adapted to selectively engage and release a needle to be formed, a rotary drive for indexing the platform and the chucks through a plurality of radial positions, and a plurality of work stations circumferentially disposed adjacent the radial positions occupied by the chucks. In accordance with one aspect of the present invention, the needle inspection station includes a base plate, an upwardly extending support member connected to the base plate, a slide member slidably received within the support member and reciprocally movable toward and away from a chuck occupying a position adjacent the inspection station, a gripper for gripping a needle to be inspected, and a needle inspection platform slidably mounted on the baseplate reciprocally moveable toward and away from a chuck occupying a position adjacent the inspection station. The slide member is moveable toward the chuck to permit the gripper to engage the needle, retract it from the chuck and rotate it 180 degrees to reverse the orientation of the needle relative to the chuck. The slide member is then moveable back toward the chuck to allow the gripper to replace the needle in the chuck. The needle inspection platform is moveable toward the chuck to permit the needle point to be tested. The needle inspection platform includes a stop containing a resilient conductive material at the leading edge of the platform and a strip of nonconductive material disposed between the stop and the chuck, such that when the strip is moved into contact with a needle extending from a chuck, a properly formed needle point will penetrate the strip and make electrical contact with the stop, thereby signaling a programmable logic controller connected to the stop that a properly formed needle has been detected.

In accordance with a second aspect of the invention, the specification discloses a method for inspecting the point of a drilled taper point needle formed in a combined index machine of the type having a plurality of work stations circumferentially spaced adjacent the positions occupied by a rotating chuck containing a needle to be formed. At the needle point inspection station, a needle held in a chuck is gripped by a pair of gripper fingers on the barrel thereof. The chuck is then opened and the gripper fingers retract the needle from the chuck barrel and rotate the needle approximately 180 degrees to reverse the orientation of the needle. The gripper fingers then insert the needle back into the chuck with the needle point extending from the chuck and the chuck jaws are closed to hold the needle for inspection. A point inspection platform containing a resilient conductive material and a strip of nonconductive material disposed between the stop and the chuck is then advanced and retracted from the chuck such that a needle with a properly formed point will penetrate the strip of nonconductive material and make electrical contact with the stop. The presence of a current in the stop, indicating that a properly formed taper point has been detected, is recorded by a programmable logic controller for controlling the disposition of needles at a subsequent work station.

DETAILED DESCRIPTION OF THE INVENTION

Figure 1:
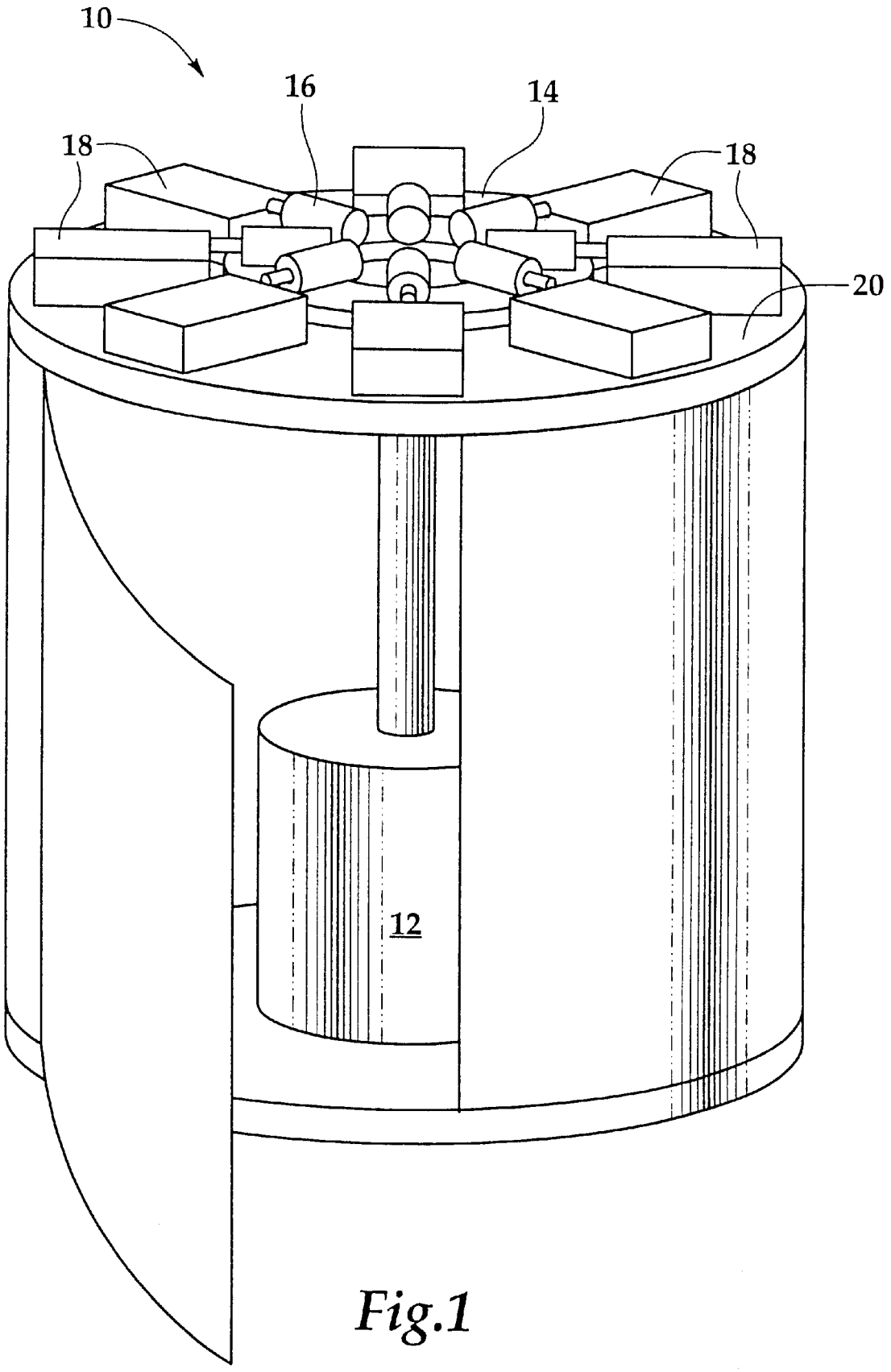
FIG. 1 is a perspective view of a prior art index machine.

Referring to FIG. 1, an index machine 10 is shown having a Ferguson rotary drive 12 connected to a rotating platform 14 on which are mounted a series of eight equidistantly spaced chucks 16 for holding needle blanks to be formed by advancing chucks 16 through a plurality of work stations 18. The needle blanks are held securely within the chuck jaws as the various operations are performed on the needle blanks at each work station on the index machine. After a predetermined time, drive 12 causes platform 14 to rotate 45 degrees to advance chuck 16 to the next work station for subsequent processing of the needle blank.

Figure 2:
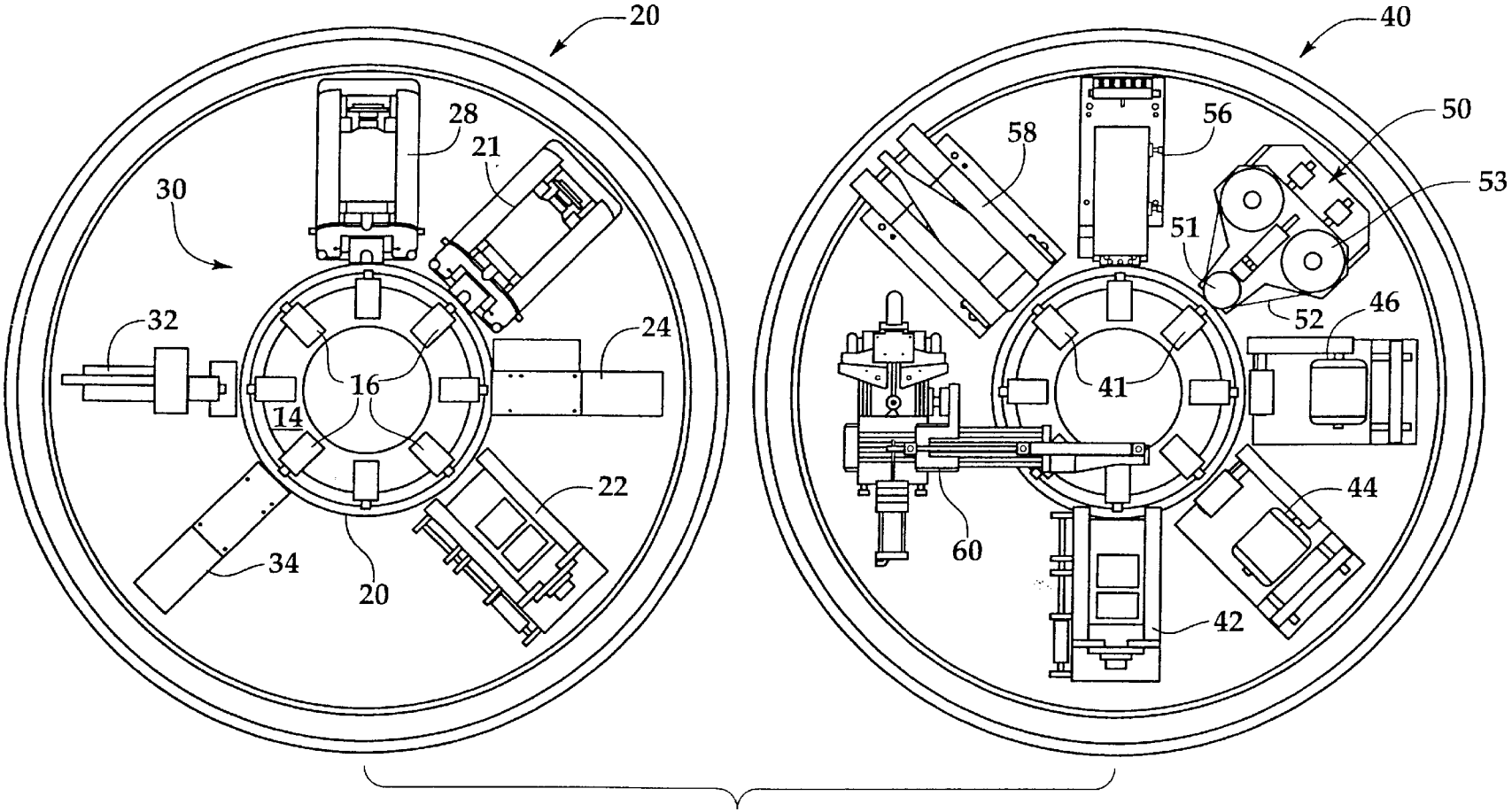
Fig.2 (PRIOR ART)
FIG. 2 is a top plan view of a pair of prior art index machines operating in tandem illustrating the stations used in a prior art process for drilling taper point needles.

FIG. 2 illustrates a pair of prior art index machines operated in tandem to process needle blanks formed on the Bundgen and Schumag machines as described above. A first index machine 20, known as an Index I machine, contains a series of stations including a feeder 22, a shear station 24, a center (chamfer) drill station 26, a microdrill station 28, an open work station 30, a hole inspect station 32 and an unload station 34.

Sharpened needle blanks are placed in an oscillating hopper of feeder 22 of the Index I machine, which delivers one blank at a time to a stationary (nonrotating) chuck 16 via a wheel feeder. The term "stationary" or "nonrotating" chuck refers to a chuck in which the needle is maintained in a fixed position in the chuck as the chuck is advanced from one station to the next. As a stationary chuck 16 is rotated or "indexed" to feeder 22, a slotted wheel in feeder 22 picks up a needle blank from the bottom of the hopper, "locates" the needle by pushing the tip up against the feeder surface, and delivers the sharpened needle blank taper first into the chuck, exposing the barrel end of the needle for processing. Next, chuck 16 is rotated from the feeder to the shear station 24 where the needle blank is cut to a specified length as called for by a particular needle code. After the shearing operation is completed, the chuck is advanced to the center drill station 26 where a cam-driven drill is used to drill a pilot hole and chamfer into the barrel end of the needle blank. The chuck is then indexed to the microdrill station 28 where the suture mounting hole of proper diameter and depth is drilled in the end of the barrel using the pilot hole as a guide. If a drill bit is broken at microdrill station 28, drilling also can be done at a backup microdrill station optionally located at open station 30. The open station 30 can also be equipped with a source of compressed air to facilitate removal of excess shavings and debris from the suture hole. The chuck is next advanced to hole inspect station 32 where the needle blank is inspected for the presence of a suture mounting hole. Hole inspect station 32 contains a probe which is inserted into the suture hole to test the hole depth. If the probe is not inserted a predetermined depth, the inspect station determines that a proper hole not been drilled, and the needle is rejected at the next station. If a proper hole has not been drilled, this may indicate that a drill bit has been broken and the machine may be stopped so the operator can replace the broken drill bit before continuing. Following hole inspection, the chuck is advanced to an unload station 34 where the needle is removed from the chuck and unloaded onto a conveyor where the needles are collected and delivered first to a wash station (not shown) to remove the drill cooling oil, then later to an oven to be dried.

At an appropriate time, the drilled needles are removed from inventory and placed in the hopper of the feeder 42 of Index II machine 40. The Index II machine 40 operates in much the same way the Index I machine does except that it has different work stations. The Index II machine employs eight rotating chucks 41, which rotate the needle blank 90 degrees along the needle's axis each time the chuck passes through a successive work station. Feeder 42 is similar in construction to feeder 22 in the Index I machine except that it delivers one needle at a time to the rotating chucks 41 barrel end first so that the tapered end of the needle is exposed for processing.

Because of damage that may have occurred to the needle point as the blank is fed into the chucks by the feeder on the Index I and Index II machines, the Index II machines provide the capability of regrinding or touching up the needle points. After the needle is positioned in the chuck 41, the chuck 41 advances to the coarse grinding station 44 where the needle point is finish ground (or reground) to remove any damage to the point and to complete the grinding process. Next, the needle blank and chuck are rotated to one or more additional fine grinding stations 46 to completely finish the point. The chuck is then advanced to needle point inspect station 50 where the profile of the needle point is checked by forcing the point into a conductive rubber wheel 51 through a strip of nonconductive MYLAR tape 52 threaded on a pair of spools 53 disposed on opposite sides of the conductive rubber wheel 51. A properly formed needle point will penetrate the MYLAR barrier, resulting in the flow of current through the needle into the conductive rubber wheel, signaling the machine that a properly formed needle has been detected. If the needle point does not penetrate the MYLAR barrier contacting the conducting rubber, the machine is stopped. A rejected needle indicates a problem on one of the grind stations, which the operator must correct before continuing. Following needle point inspection, the chuck is rotated to a reject station 56 where needles with imperfect points are removed from the chuck and the process flow. Next the needle blank and chuck are advanced to a flattening station 58 where the needle blank is flattened to provide a rib which facilitates handling of the needle by the surgeon. After the ribs are formed in the needle blank, the needle is rotated 90 degrees about the needle axis as the rotating chuck is advanced to a curving station 60. This places the ribs in the proper orientation for the needle blank to be curved to the proper radius to form a finished needle. After curving, the finished needle is unloaded onto a collection shoot into a bin. The completed needles are then washed again in a wash station to remove contaminants and dried in an oven before they are sent to the static anode for further finishing.

Figure 3:
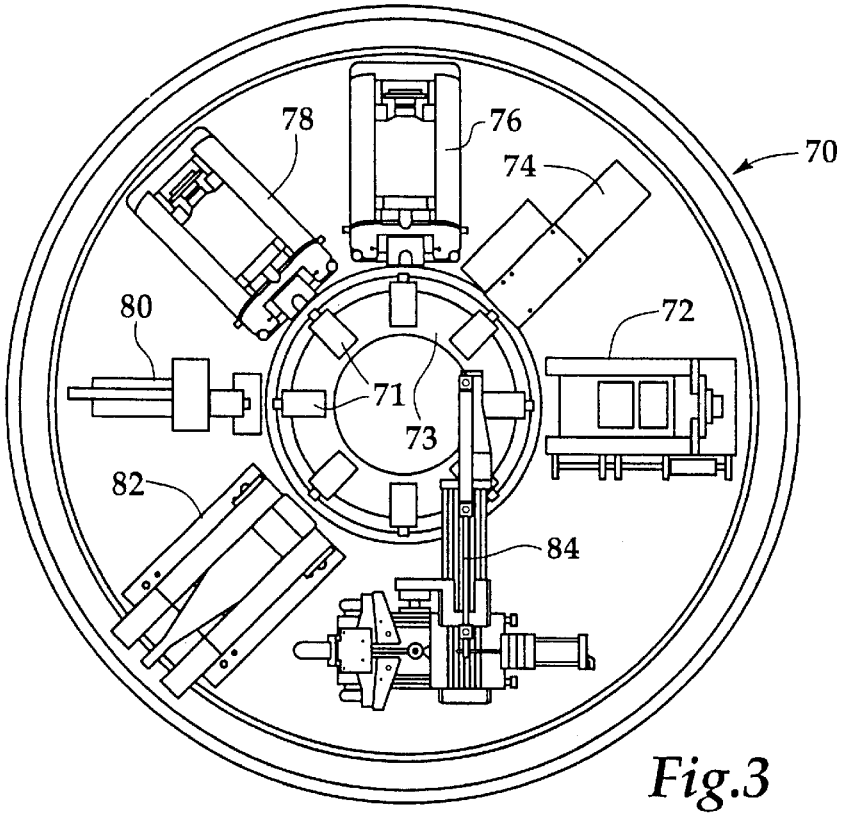
Fig.3 (PRIOR ART)
FIG. 3 is a top plan view of a prior art combined index machine illustrating the stations for drilling taper point needles.

As previously explained, efforts were made in the late 1980s to combine the functions of the Index I and Index II machines into a single index machine. FIG. 3 illustrates the operation of one such combined Index I/II machine 70 developed in Brazil in the late 1980s. In combined Index I/II machine 70, the functions performed by the Index I and Index II machines are combined on a single index machine and the intermediate step of washing and drying semi-finished needles from the index I machine are completely eliminated.

Referring to FIG. 3, the combined Index I/II machine 70 employ rotating chucks 71 similar to rotating chucks 41 on the Index II machine. Sharpened needle blanks formed on Schumag and Bundgen machines are loaded into a hopper of a modified feeder 72. The modified feeder 72 is similar to the feeder in the Index I and Index II machines except that a spring mechanism is used to locate the needle in the wheel and the needle point is located or biased against a resilient material to minimize point damage. After the needle blank is loaded into chuck 71, chuck 71 is advanced to shear station 74 which is similar to the shear station in the Index I machine. After the needle blank is cut to the proper length at shear station 74, the needle and rotating chuck 71 are then indexed to the center drill and microdrill stations 76 and 78, respectively, where the suture hole is drilled in the same manner as in the Index I machine. At the hole inspection station 80, a probe is provided, as in the Index I machine, to test the depth and diameter of the suture hole. The chuck is next advanced to the flattening station 82, where flattening dies are pressed against the barrel to form ribs in the same manner as in the Index II machine. As the chuck advances from the flattening station to the curving station 84, rotating chucks 71 rotate the needle 90 degrees along the needle's axis to properly position the ribs before curving the needle. At curving station 84, the needle is removed from the chuck, curved in a curving assembly identical to the curver employed in the Index II machine, then unloaded or rejected.

Figure 4:
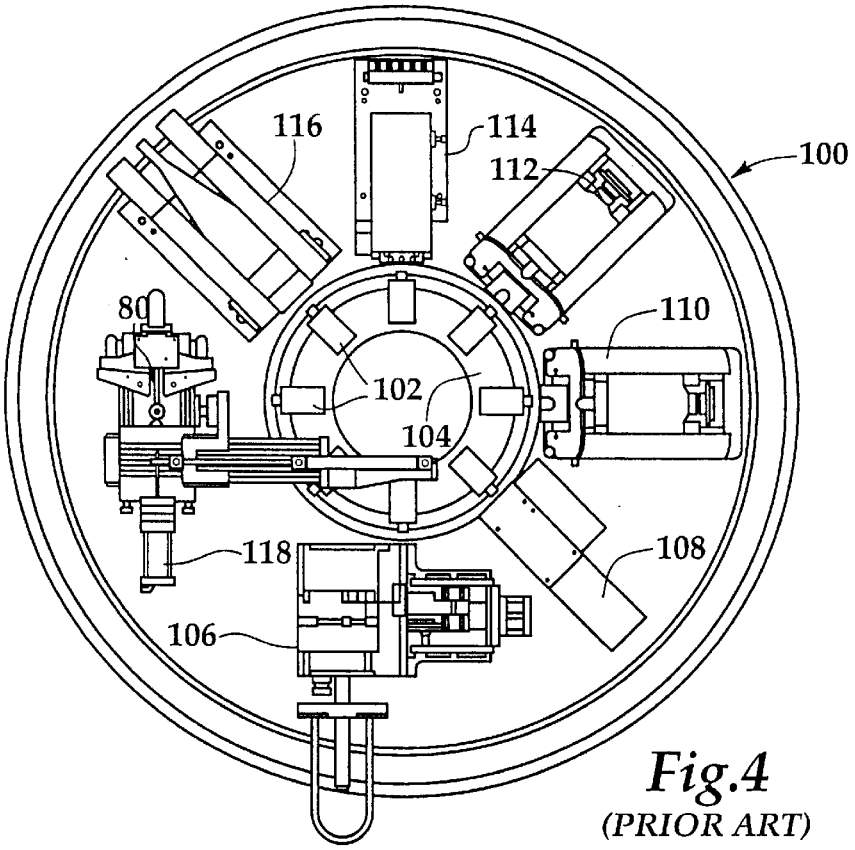
Fig.4 (PRIOR ART)
FIG. 4 is a top plan view of the a second prior art combined index machine illustrating the stations for drilling taper point needles.

In the early 1990s, a parallel effort was made in the United States to combine the functions of the Index I and Index II machines into a single index machine, known as the Drilled Needle Indexing Primary machine or "DNIP" machine. FIG. 4 illustrates the operations performed by DNIP machine 100. The DNIP machine 100 operates completely under the control of a programmable logic controller. In the DNIP machine, eight rotating chucks 102 are mounted on a rotating platform 104. Rotating chucks 102 are sequentially advanced through a series of stations including a Schmidt feeder 106, a shearing station 108, a center drill station 110, a microdrill station 112, an inspect/reject station 114, a flattening station 116 and a curving station 118.

Schmidt feeder 106 is an improved feeder designed to avoid damage to the needle point that can occur in Index I and Index II type feeders and to ensure that the needle is placed in the chuck at the proper depth. Schmidt feeder 106 contains a stationary hopper and a pile disrupting element or "rake" for dispersing needles in the hopper to facilitate movement of needles in a single stack at the bottom of the hopper. At the bottom of the hopper, a pair of fingers operating under the control of the programmable logic controller (not shown) engage a needle blank along the taper and position the needle point in the chuck 102 thereby eliminating any contact between the needle point and the feeder surface. Shearing station 108 is identical to the shearing station in the prior art Index I machine. The center drill station 110 and microdrill station 112 are identical to the center drill and microdrill stations in the Index I machine.

The hole inspect/reject station 114, in the embodiment of the DNIP machine shown in FIG. 4, checks the hole in the barrel end of the needle to ensure that there is a hole and that the hole has the correct depth. If the hole does not have the correct depth, a sensor sends a signal to the programmable logic controller indicating that the needle is bad, and the needle is rejected at station 114. If the hole is properly formed, hole inspect/reject station 114 pulls the needle out of the chuck a predetermined distance so that it can be processed at flattening station 118. The flattening station and curving stations 116 and 118, respectively, are essentially identical to the flattening and curving stations on the Index II machine.

In a subsequent, alternate embodiment of DNIP machine 100, the hole inspect and reject functions of station 114 were separated, and the hole inspection function was carried out at the microdrill station 112. In this case, the retract and advance drive system of microdrill station 112 is replaced with a stepper motor drive system and a load cell to monitor the force of drilling. When the drilling force drops below a certain threshold indicative of a broken drill bit or other problem, DNIP machine 100 is stopped by the programmable logic controller 115. In this embodiment, the modified station only pulls the needle partially out of the chuck for flattening at the next station.

Figure 5:
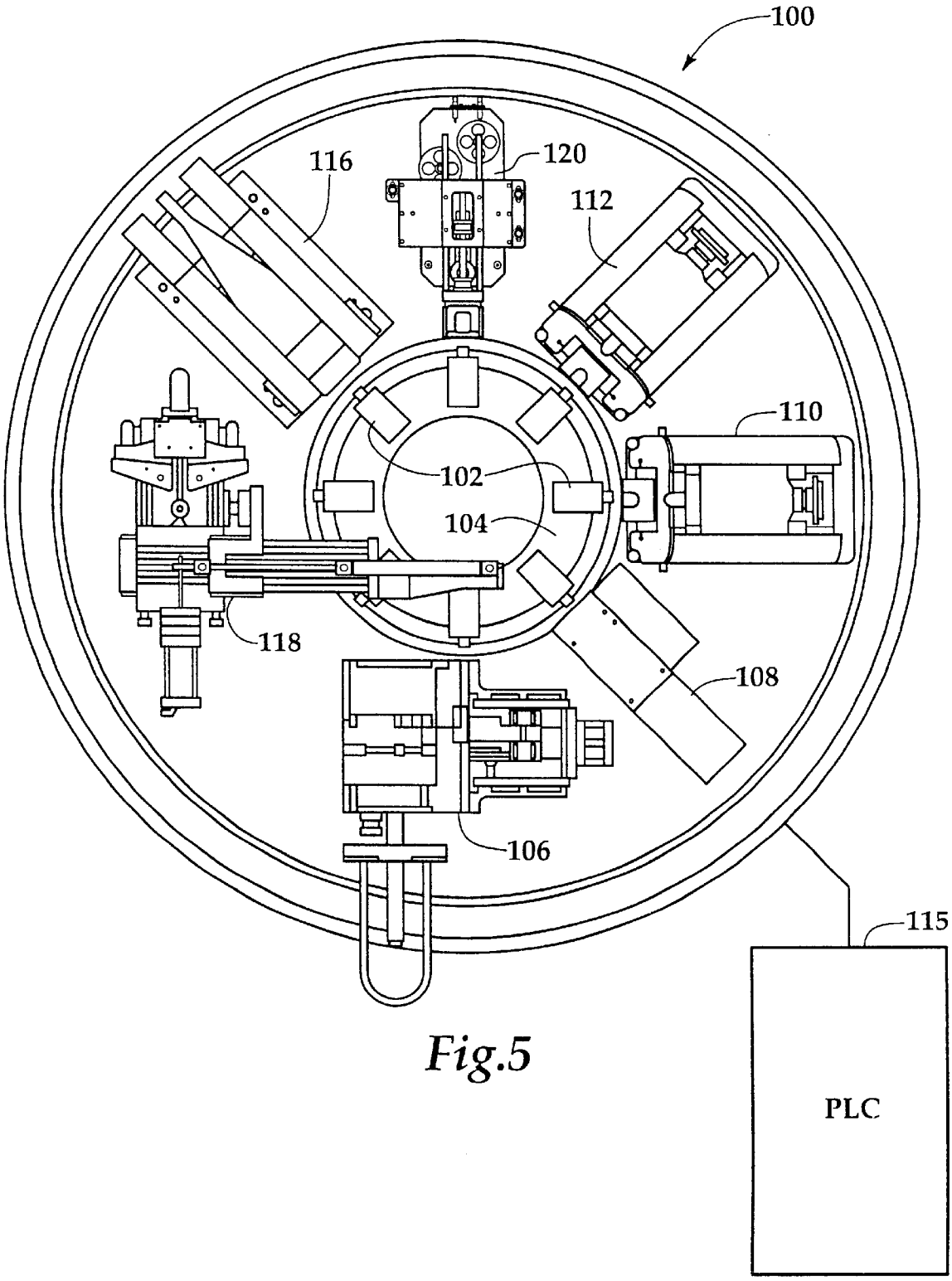
FIG. 5 is a top plan view of an alternative embodiment of the machine illustrated in FIG. 4 equipped with the improved needle inspection station of the present invention.
Figure 6:
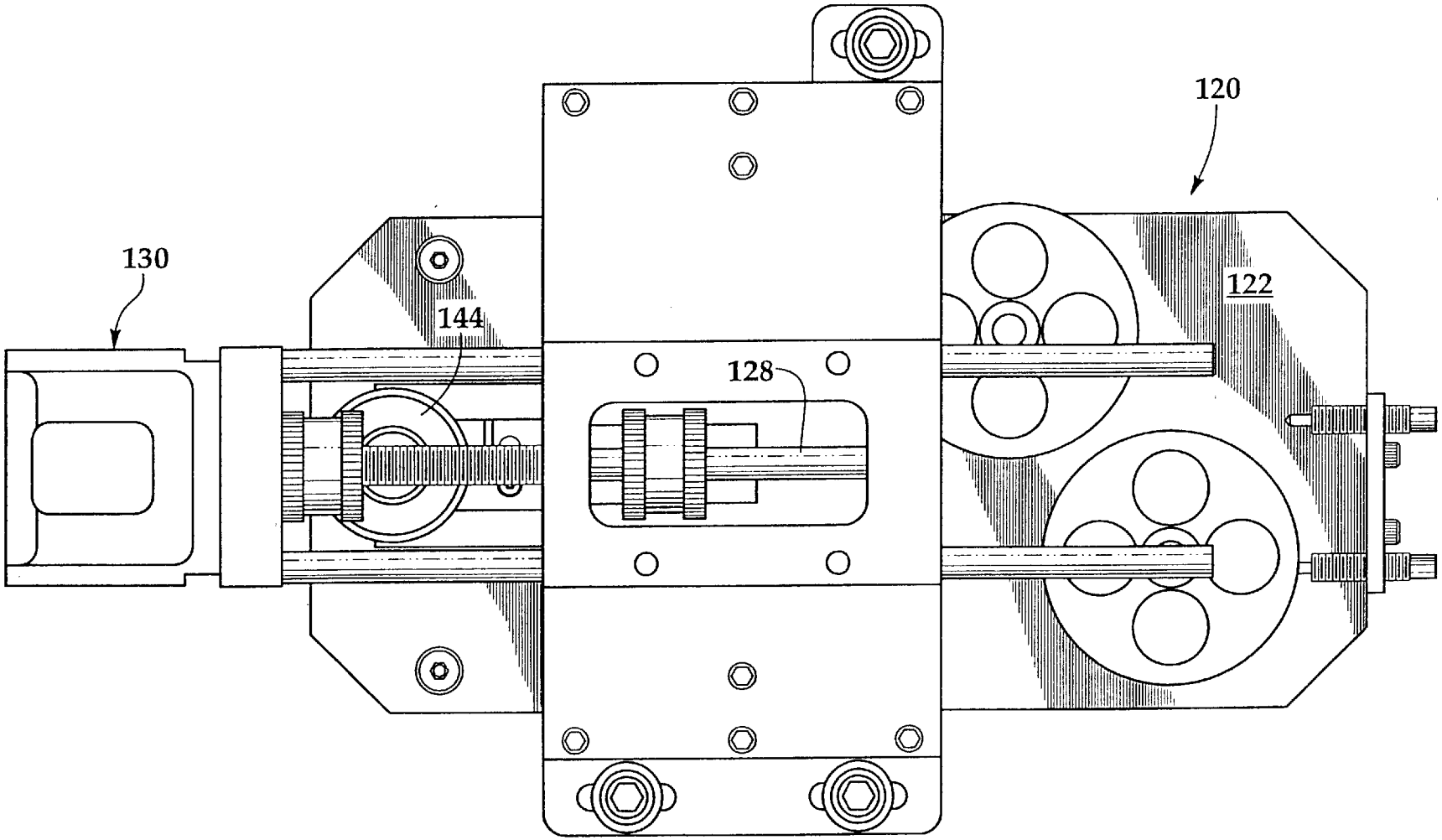
FIG. 6 is a top view of the needle inspection station of the present invention.

FIG. 5 illustrates the improved needle point inspect station of the present invention employed in the alternate embodiment of the DNIP machine described above in which the hole inspection function is carried out at the microdrill station. In the embodiment shown in FIG. 5, the hole inspection function is performed by microdrill station 112 as described above. However, a needle point inspection function not previously available in the combined prior art index machines is now carried out at the location of the previous hole inspect/reject station 114.

As shown in FIG. 5 the sharpened needle blank is loaded point first into a rotating chuck 102 by Schmidt feeder 106. The chuck is closed and indexed to shearing station 108 where the blank is cut to proper length. The chuck is next advanced to the center drill station 110 where a pilot hole is formed in the barrel end of the needle and then to the microdrill station 112 where a hole of proper depth is drilled into the barrel as previously described. The drilling force is monitored at station 112 by a stepper motor drive system and a load cell to detect when the drilling force drops below a certain threshold, indicative of a broken drill bit. Following drilling, the chuck is next advanced to the needle point inspection station 120 of the present invention where the point of the needle is inspected as hereafter described. After the results of the point inspection are sent to the programmable logic controller 115 and recorded, the chuck advances to the flattening station 116 and the curving station 118 where the processed needle is either rejected or unloaded under the control of the programmable logic controller 115.

Referring now to FIGS. 6–9, the needle point inspection station 120 is shown in greater detail. Needle point inspection station 120 comprises a base plate 122, an upwardly extending support member 124 (FIG. 7) rigidly connected to base plate 122, a slidable needle handling assembly 126 (FIGS. 6–7) connected to the base plate via a slide member 128 and a point inspection platform 140 movable relative to base plate 122.

When a chuck containing a needle to be tested is advanced from the microdrill station 112 to a radial position adjacent the needle point inspect station 120, the needle taper is pointing into the chuck because a suture hole has just been drilled in the barrel end at the previous station. At the needle inspection station 120, the needle handling assembly 126 is advanced toward the chuck where the needle handling assembly 126 grips the needle along the barrel. The chuck 102 is then opened and the needle handling assembly 126 then pulls the needle out of the chuck a predetermined horizontal distance clear of the chuck. The needle handling assembly 126 then rotates the needle 180 degrees about an axis perpendicular to the needle's axis so that the needle now points out of the chuck. Assembly 126 then returns the needle to the chuck with the barrel end in the chuck. Then chuck is then tightened to prepare the needle for point inspection.

Figure 7:
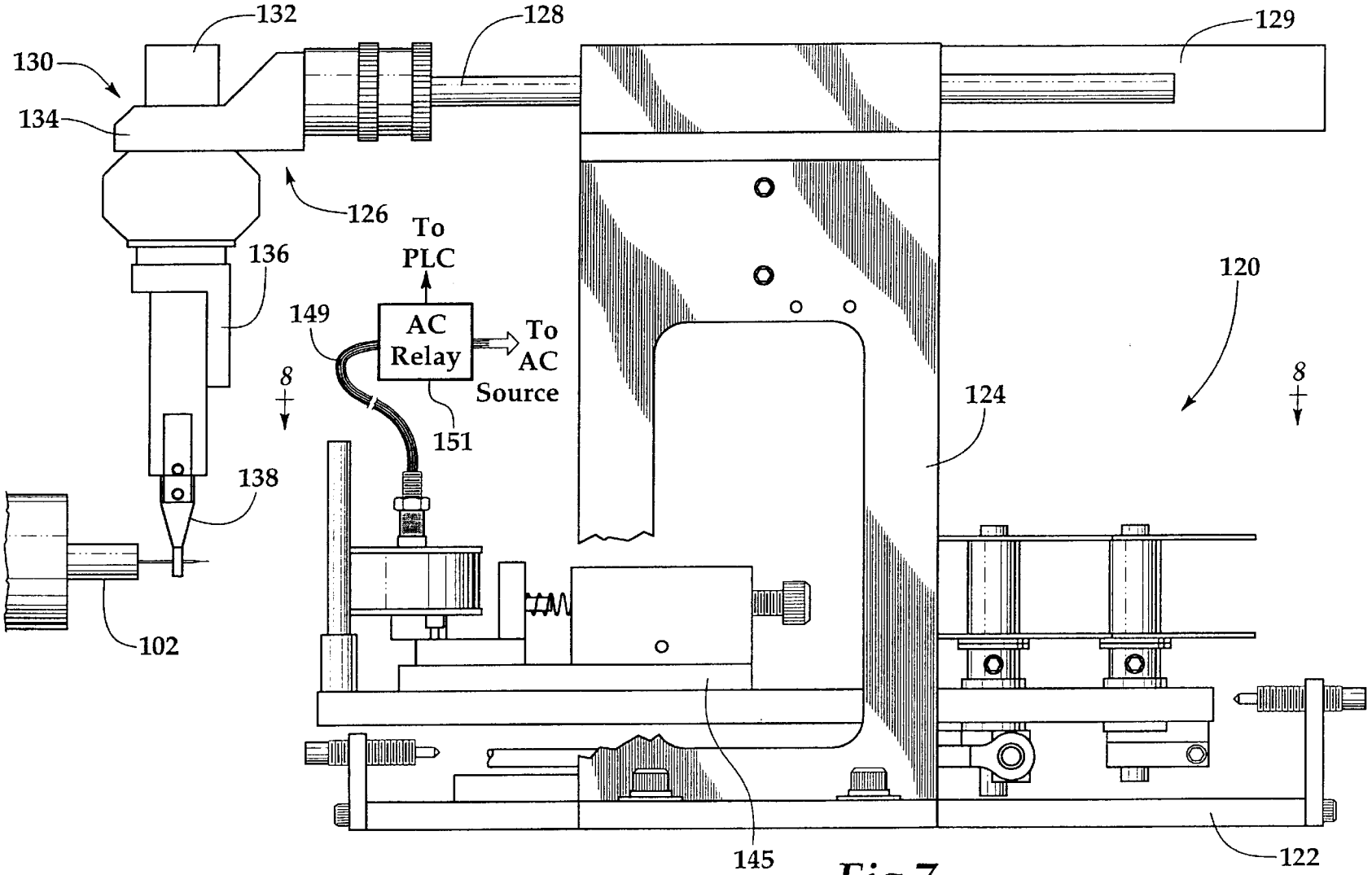
FIG. 7 is a side view of the needle inspection station of the present invention.
Figure 8:
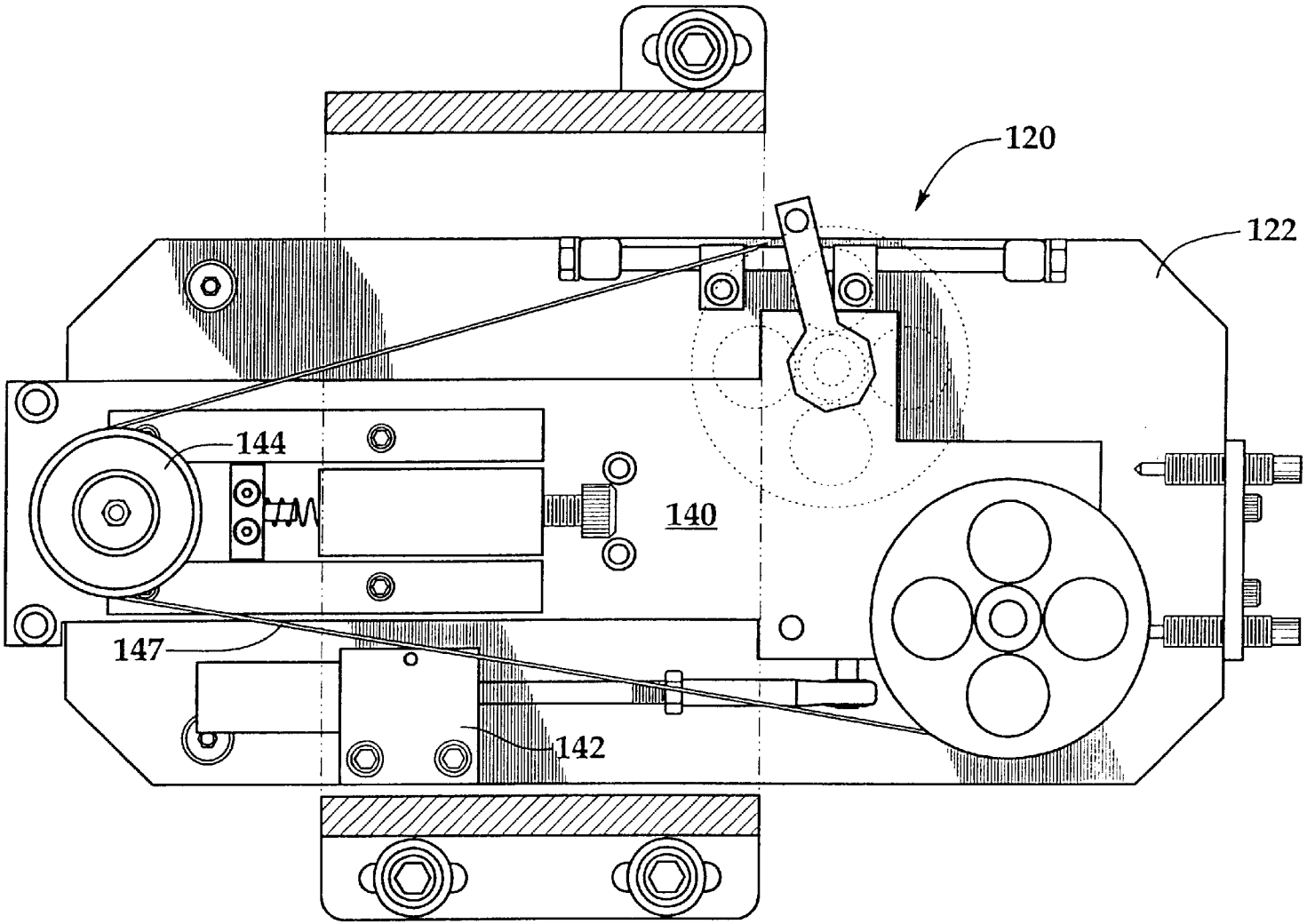
FIG. 8 is a top section view of the needle inspection station of the present invention taken along the line 7—7 of FIG. 7.
Figure 9:
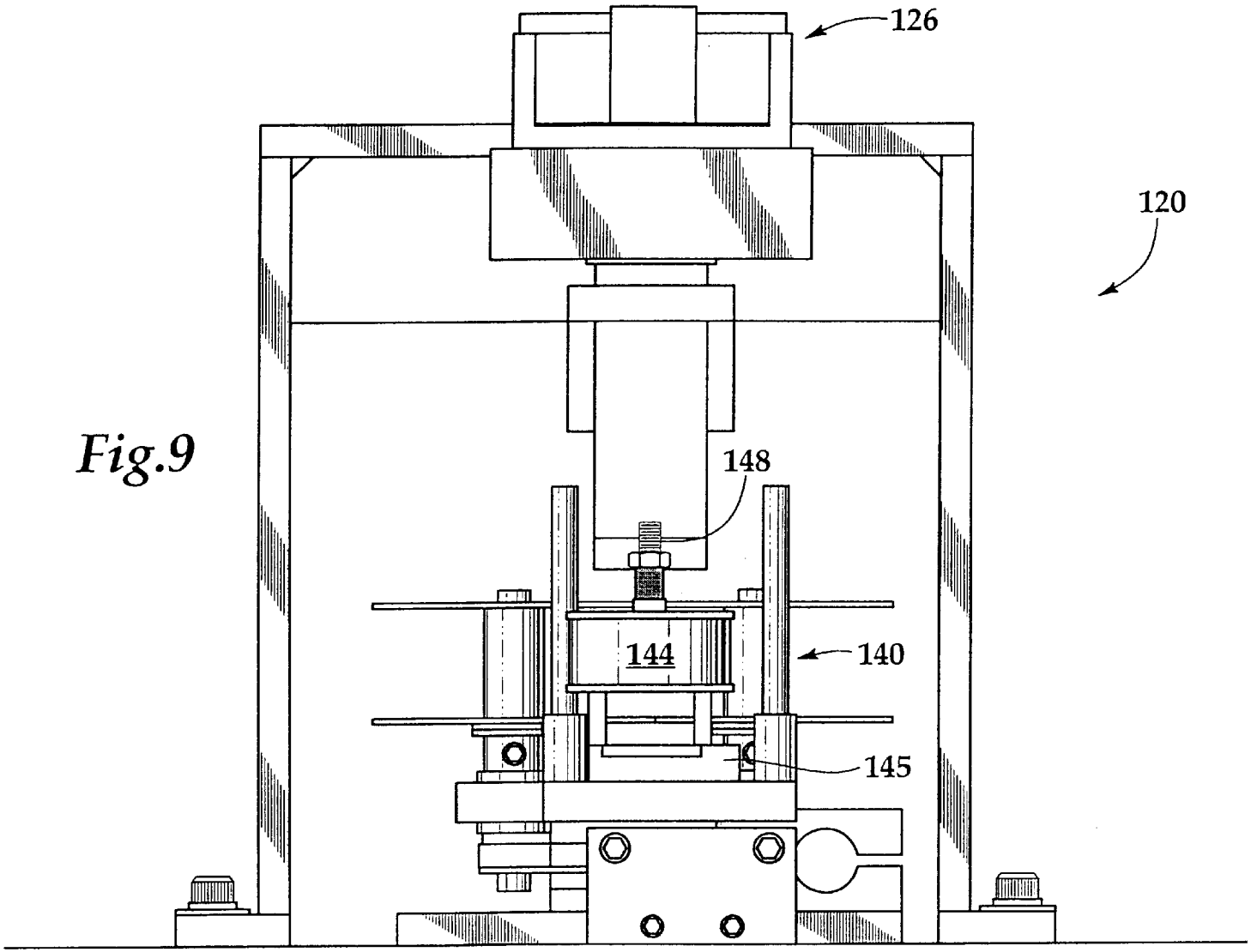
FIG. 9 is a front view of the needle inspection station of the present invention.

As best seen in FIG. 7, needle handling assembly 126 comprises a powered slide member 128 actuated by an air cylinder under the control of programmable logic controller 115. Slide member 128 is reciprocally moved toward and away from the chuck predetermined distances to retrieve the needle, reverse its orientation and replace it in the chuck. Slide member 128 is connected to a gripper module 130 which comprises a gripper shank 132, a swivel unit support 134 for facilitating movement of the gripper shank 132 in a direction perpendicular to the axis of rotation of the chuck, an adapter plate 136 and a pair of retractable gripper fingers 138.

When a chuck with a needle to be inspected moves into a radial position adjacent the needle point inspection station 120, the slide member 128 and needle handling assembly 126 are advanced under the control of the programmable logic controller 115 toward the chuck a predetermined distance such that the retractable gripper fingers 138 will engage the barrel of the needle in their downward position. At this point the retractable gripper fingers 138, which are normally maintained in a horizontally extending position (pointing into or out of the paper), are actuated into their downward (vertical) position shown in FIG. 7. Thus disposed, the gripper fingers engage the barrel of the needle. As soon as the gripping fingers engage the needle, the chuck jaws are opened and the slide member and needle handling assembly are then retracted from the chuck, causing the needle to be pulled out of the chuck sufficient distance to permit the needle to be rotated clear of the chuck. Gripper shank 132 is then rotated 180 degrees about a vertical axis perpendicular to the needle so that the needle is positioned with the taper pointing away from the chuck. With the gripping fingers still in their downward position, the slide member 128 and needle handling assembly 126 are then advanced toward the chuck, and the needle is inserted into the chuck barrel end first exposing the tapered point for further inspection. When the needle is returned to the chuck it is only positioned at a depth in the chuck that will require no further extraction from the chuck before flattening. The chuck is then closed, the gripping fingers 138 are retracted to their horizontal position, the rotating gripping shank is rotated 180 degrees and the slide member 128 is retracted to its original position to reposition the needle handling assembly 126 for handling the next needle to be processed. The reciprocal movement of the slide member 128 toward and away from chuck 102, the opening and closing of retractable gripping fingers 138, the opening and closing of the chuck and the rotation of the gripper shank is synchronized under the control of programmable logic controller 115 (FIG. 5)

Following retraction of the needle handling assembly 126, the point inspection platform 140 now advances toward the needle to inspect the tapered point. The point inspection platform 140 is movable relative to base plate 122 toward and away from the chuck 102 by an air cylinder 142 under the control of programmable logic controller 115. After the needle has been extracted from the chuck and reoriented with the taper pointing out, needle handling assembly 126 has been retracted and the gripping fingers 138 have been retracted into their horizontal position, platform 140 is moved from toward chuck 102 containing a needle to be tested. The leading edge of point inspection platform 140 contains a conductive rubber wheel 144 similar to the conductive rubber wheel 51 employed in the Index II machine 40 (FIG. 2). A pair of guide rods 146 is positioned on each side of platform 140 just forward of the conductive rubber wheel to support and feed a strip of MYLAR tape 147 or other suitable nonconductive material between the needle and wheel assembly. Conductive rubber wheel 144 is electrically isolated from ground by the an insulator 145 and is connected to an AC current sensitive relay 151 through conductor 148 via cable 149. Relay 151 is connected to an AC power source, and the needle, chuck and index machine are grounded.

A pair of spools—feeder spool 150 and take up spool 152—are provided for feeding MYLAR tape to and from guide rods 146. Spool 150 feeds an unused MYLAR strip to guide rods 146 while take up spool 152 winds up the used portion of the strip. Take up spool 152 is connected to a ratchet mechanism 154, which is actuated by movement of the point inspection platform on the return cycle. Ratchet 154 causes the strip to incrementally advance a predetermined distance each time a needle point is inspected so that the region of the MYLAR strip adjacent the needle is free of penetrations.

When the point inspection station advances toward the needle, the MYLAR tape will be penetrated by a properly formed needle. If the MYLAR tape is penetrated by the needle, the AC current sensitive relay 151 detects a change in resistance (or current), allowing the circuit to be completed to ground, and the relay 151 sends a signal to programmable logic controller 115 that the needle is acceptable. The programmable logic controller 115 records the existence of a current (indicative of a good needle) or the absence of a current (indicative of a bad needle) and the needle is either accepted or rejected at curving station 118 (FIG. 5). The point inspect assembly then retracts under the control of the programmable logic controller 115, where it engages the ratchet mechanism advancing the MYLAR tape a predetermined distance, and the chuck is advanced to the flattening station 116.

It will be understood that various modifications can be made to the embodiments of the present invention without departing from the spirit and scope of the invention. Therefore, the foregoing description should not be construed as limiting the invention, but merely as an example of preferred embodiments thereof. Those skilled in the art will envision other modifications within the scope and spirit of the present invention as defined by the appended claims.

It is claimed:

1. For use in an index machine for forming drilled taper point needles, the machine of the type having a plurality of chucks mounted on a rotating platform adapted to selectively engage and release a needle to be formed, a rotary drive for indexing the platform and the chucks through a plurality of radial positions, and a plurality of work stations circumferentially disposed adjacent the radial positions occupied by the chucks, an improved needle inspection station adapted to occupy one of the work stations for inspecting the point of a needle oriented inwardly of a chuck occupying a position adjacent the inspection station, comprising:

a base plate;

an upwardly extending support member connected to the base plate;

a slide member slidably received with the support member and reciprocally movable radially of a chuck occupying a position adjacent the inspection station;

gripping means for gripping a needle to be inspected, the gripping means capable of rotation relative to the slide member to permit the gripping means to rotate a needle approximately 180 degrees to reverse the orientation of the point relative to the chuck;

the slide member movable radially of a chuck between a first radial position wherein the gripping means engages a needle in the chuck and a second radial position located distally of the chuck wherein the needle may be rotated approximately 180 degrees to reverse the orientation of the point relative to the chuck;

a platform slidably mounted on said baseplate reciprocally movable radially of a chuck occupying a position adjacent the inspection station for reciprocal movement between a first radial position located distally of the chuck and a second radially position proximate of the chuck;

a stop containing a resilient conductive material mounted to at the leading edge of the platform;

a strip of nonconductive material retained on the platform and disposed radially inwardly of the stop and a outwardly of a chuck occupying a position adjacent the inspection station such that when the strip is moved into contact with a needle extending from a chuck, a properly formed point will penetrate the strip, making electrical contact with the stop;

current detection means connected to the stop for detecting electrical contact between the needle and the stop; and control means, connected to current detection means and responsive to the detection of electrical contact between the needle and the stop, for controlling the unloading of properly formed needles at a subsequent work station.

2. The inspect station of claim 1 wherein the gripping means includes a pair of horizontally biased fingers movable between horizontal and vertical positions for selectively engaging and releasing a needle.

3. The inspect station of claim 2 wherein the gripping means is rotatable along a vertical axis parallel to the support member to permit the fingers engaging a needle to rotate the needle 180 degrees to change the orientation of the needle point relative to the chuck.

4. The inspect station of claim 1 further comprising:

a pair of guide rods mounted on the leading edge of the platform;

a pair of spools rotatably mounted on the base plate for feeding and positioning a strip of the nonconductive material radially outwardly of the stop and inwardly of a chuck occupying a position adjacent the inspect station; and a ratchet connected to one of the reels and actuated by mechanical contact with the platform for advancing the strip around the guide rods between the stop and the chuck when the platform is reciprocally moved radially inwardly and outwardly of a chuck occupying a position adjacent the inspection station.

5. A method for inspecting the point of a drilled taper point needle formed in an index machine having a plurality of work stations circumferentially spaced adjacent the positions occupied by a rotating chuck containing a needle to be formed, comprising the steps of:

(a) gripping the needle oriented with the point inward of the rotating chuck on each side thereof by moving a pair of horizontally biased grippers into vertical position to engage opposite sides of the barrel;

(b) opening the chuck to disengage the needle;

(c) retracting the needle from the chuck barrel end in a direction radially outwardly of the chuck;

(d) rotating the needle approximately 180 degrees in a plane perpendicular to the axis of the chuck such that the orientation of the point is outwardly of the chuck;

(e) inserting the needle into the chuck barrel such that the point is oriented outwardly of the chuck;

(f) closing the chuck to engage the needle;

(g) advancing a platform containing a resilient conductive material and a strip of nonconductive material disposed inwardly of the stop and outwardly of a chuck occupying a position adjacent the inspection station radially of the chuck such that a needle with a properly formed point will penetrate the strip of nonconductive material and make electrical contact with the stop;

(h) detecting electrical contact between the needle and the stop whenever the needle point penetrates the nonconductive strip;

(i) recording the detection of electrical contact between the needle and the stop indicative that a properly formed needle has been detected in a programmable logic controller for controlling the unloading of properly formed needles at a subsequent work station;

(j) retracting the platform radially outwardly of the chuck; and (k) indexing the chuck containing the inspected needle to a subsequent work station for additional processing.

6. The method of claim 5, further comprising the step of:

moving the grippers into a horizontally extending position and rotating the grippers 180 degrees in said horizontal position following rotation of the needle in step (d).

7. The method of claim 5 wherein the strip of nonconductive material is advanced relative to the stop each time the platform is retracted from a chuck.

* * * * *